United States Patent [19]

White

[11] 3,995,971

[45] Dec. 7, 1976

[54] ROTATABLE VANE SEAL

[75] Inventor: Loren Hawdon White, East Hartford, Conn.

[73] Assignee: United Technologies Corporation, Hartford, Conn.

[22] Filed: June 2, 1975

[21] Appl. No.: 583,141

[52] U.S. Cl. ..... 415/160; 415/117

[51] Int. Cl.[2] ..... F01D 17/16; F01D 17/14

[58] Field of Search ..... 415/115, 116, 117, 160, 415/161, 162; 308/26, 21; 16/2

[56] References Cited

UNITED STATES PATENTS

| | | | |
|---|---|---|---|
| 2,651,492 | 9/1953 | Feilden | 415/160 |
| 2,857,214 | 10/1958 | Kogstrom | 308/71 |
| 3,224,194 | 12/1968 | DeFeo | 415/160 |
| 3,329,453 | 7/1967 | Patton | 308/26 |
| 3,558,237 | 1/1971 | Wall | 415/160 |
| 3,565,496 | 2/1971 | Latussek | 308/26 |

*Primary Examiner*—Carlton R. Croyle
*Assistant Examiner*—L. J. Casaregola
*Attorney, Agent, or Firm*—Robert C. Walker

[57] ABSTRACT

Means for preventing the wasteful leakage of cooling air within the turbine section of a gas turbine engine is disclosed. A segmented shroud radially separates the flow path for the working medium gases from cooling air supply chambers which are disposed radially outward of the flow path. Rotatable vanes penetrate the shroud and extend into the medium flow path to control the flow of medium gases through the turbine. A ring, which is split, is urged against the vane and the adjacent shroud segments in operative response to a spring member to prevent the excess leakage of cooling air therebetween.

2 Claims, 4 Drawing Figures

ROTATABLE VANE SEAL

The invention described herein was made in the course of or under a contract with the Department of the Navy.

BACKGROUND OF THE INVENTION

1. Field of the Invention

This invention relates to gas turbine engines and more particularly to engines having nozzle guide vanes which are both rotatable and coolable at the inlet to the turbine.

2. Description of the Prior Art

In a gas turbine engine of the type referred to above, pressurized air and fuel are burned in a combustion chamber to add thermal energy to the medium gases flowing therethrough. The effluent from the chamber comprises high temperature gases which are flowed downstream in an annular flow path through the turbine section of the engine. Nozzle guide vanes at the inlet to the turbine direct the medium gases onto a multiplicity of blades which extend radially outward from the engine rotor. The nozzle guide vanes are particularly susceptible to thermal damage and are commonly cooled to control the temperature of the material comprising the vanes in the face of high turbine inlet temperatures. Cooling air from the engine compressor is bled through suitable conduit means to an annular chamber which is located radially outward of the working medium flow path. The platforms of the nozzle guide vanes in conventional constructions separate the cooling air in the chamber from the working medium gases in the flow path.

Recent efforts to improve the performance of gas turbine engines have shown that variations in the turbine nozzle area under diverse operating conditions is advantageous. In most constructions the area variation is accomplished by rotating the nozzle guide vanes at the inlet to the turbine. A typical rotating vane construction is shown in U.S. Pat. No. 3,224,194 to DeFeo et al entitled "Gas Turbine Engine". In DeFeo et al the rotatable vane, which is supported at both the internal and external walls of the medium flow path, is also coolable. Cooling air is supplied to the vane through air chambers and conduits internally of the medium flow path. A plurality of shroud segments each having an hourglass shape separate the air chambers from the medium flow path. The rotatable vane extends between each pair of adjacent shroud segments and into the flow path with sealing means being provided at the upstream and downstream ends of the shroud segments but not at their interfaces with the rotatable vanes. Under divergent thermal conditions wherein the temperature of the shroud material varies from that of the shroud supporting structure, the gap between adjacent shroud segments becomes excessive and allows the wasteful leakage of cooling air therethrough.

Inasmuch as the modern turbines which employ the described rotatable vanes are operated at very high inlet temperatures, the thermal divergence of the components is substantial and improved means for containing the cooling air under these conditions is required.

SUMMARY OF THE INVENTION

A primary object of the present invention is to improve the performance of a gas turbine engine by preventing the wasteful leakage of cooling air from supply chambers within the turbine. Another object is to minimize the size of the flow discontinuities along the path of the working medium gases in the turbine.

According to the present invention the flow path for the working medium gases in the turbine section of a gas turbine engine having rotatable nozzle guide vanes is radially separated from a cooling air chamber by a continuous shroud comprising a plurality of arcuate segments and the platforms of the guide vanes mounted therein; sealing means are disposed between the platforms and the shroud segments and are adapted to prevent the leakage of excessive cooling air around the platform under diverse thermal conditions.

A principle feature of the present invention is the hourglass shape of each shroud segment which forms in conjunction with the next adjacent segment a cylindrical aperture which is adaptable to receive a rotatable vane. Each vane has a cylindrical platform section which is rotatably mounted in one of the apertures. A split ring is urged against one of the cylindrical apertures and the platform section of the vane mounted therein in operative response to a spring member.

A primary advantage of the present invention is the ability of the sealing means to prevent the excessive flow of cooling air from the supply chamber across the flow path shroud, notwithstanding positional variations of the individual shroud segments under diverse thermal conditions. Concomitantly, the medium flow losses which are caused by surface discontinuities along the shroud are minimized through the axial alignment of the gaps between adjacent shroud segments with the corresponding nozzle guide vanes.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
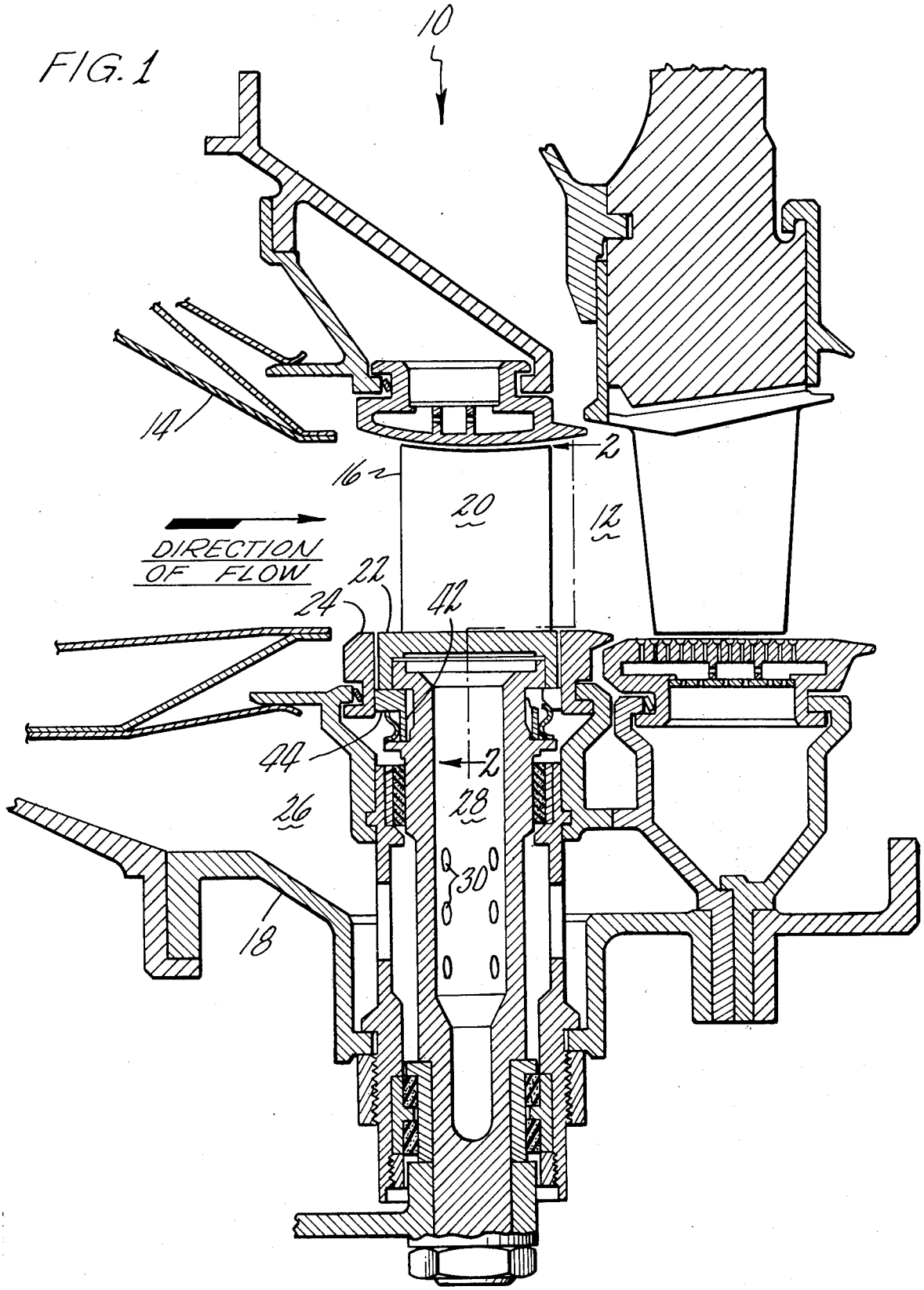
FIG. 1 is a cross section view showing a nozzle guide vane at the entrance to the turbine section of an engine.

A portion of a gas turbine engine having a turbine section 10 is shown in FIG. 1. The turbine section has an annular flow path 12 extending axially downstream from a combustor 14. Disposed across the flow path is a nozzle guide vane 16 which is cantilevered from a turbine case 18 and is rotatable in the embodiment shown. Each vane has an airfoil section 20 and a platform section 22. A plurality of the vanes 16 is spaced circumferentially within the flow path at the location shown. The platform section of each vane is surrounded by a shroud 24 which, in conjunction with the platform sections, separates the flow path 12 from a cooling air chamber 26. The platform section 22 of each vane has a cavity 28 in communication with the chamber 26 through orifices 30.

Figure 3:
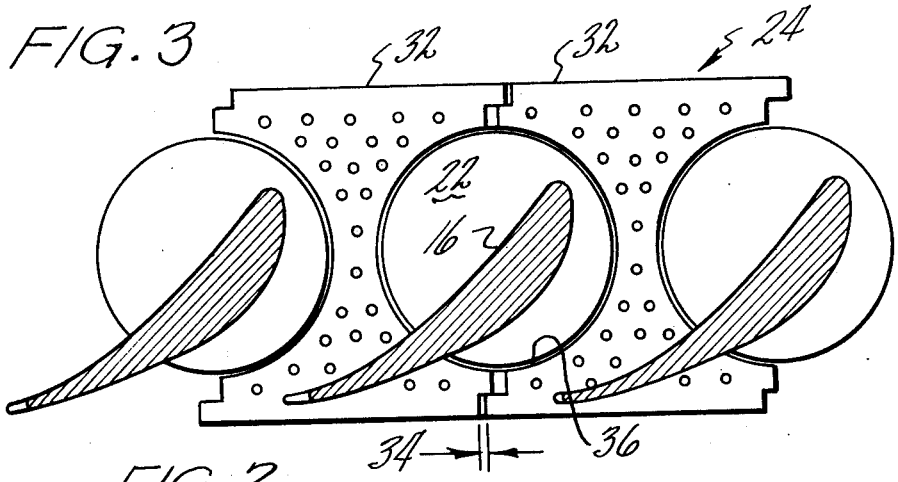
FIG. 3 is a sectional view taken along the line 3—3 as shown in FIG. 2.
Figure 2:
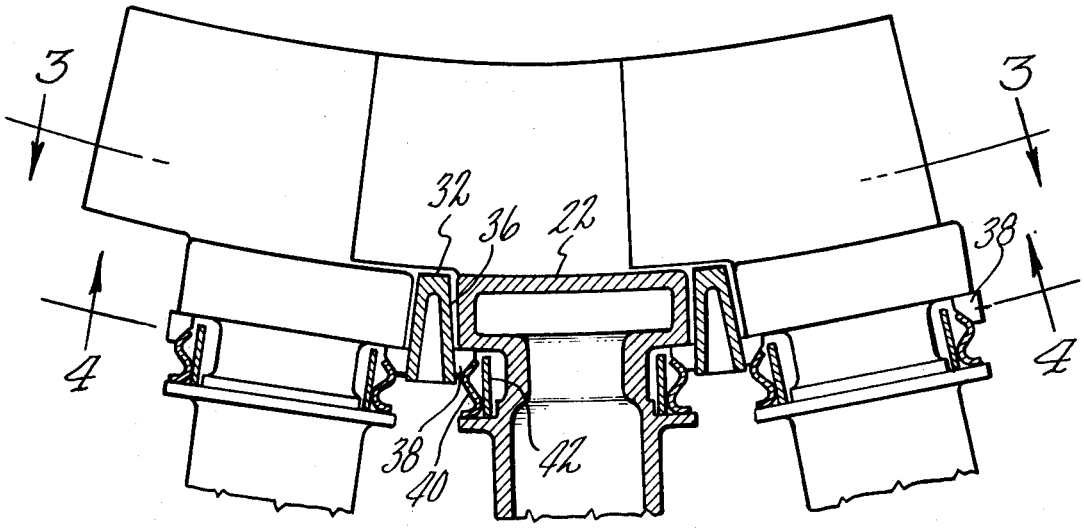
FIG. 2 is a sectional view taken along the line 2—2 as shown in FIG. 1.
Figure 4:
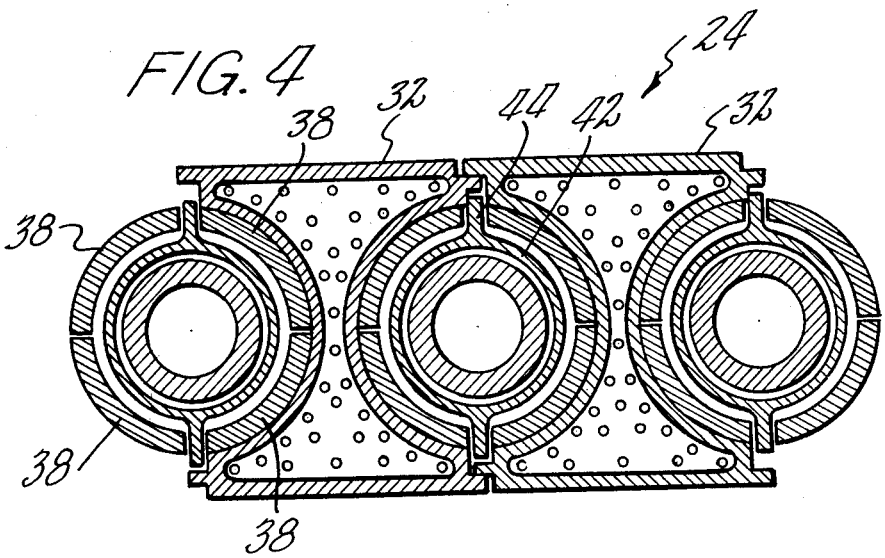
FIG. 4 is a sectional view taken along the line 4—4 as shown in FIG. 2.

As shown in FIG. 3, the shroud 24 comprises a plurality of individual segments 32 each having an hourglass shape and being circumferentially separated from the next adjacent segment by a gap 34. Each pair of the adjacent segments 32 form a cylindrical aperture 36 therebetween in which one of the vanes 16 is mounted. As is shown in FIG. 2 a split ring 38, is urged against one of the cylindrical apertures 36 and the platform section 22 of the vane mounted therein in operative response to a spring member 40. The spring member 40 is centered about the axis of the vane 16 by a guide tube 42 which has indexing tabs 44 extending outwardly therefrom as shown in FIGS. 1 and 4.

During operation of the engine high temperature working medium gases from the combustor 14 are flowed axially downstream through the flow path 12. The maximum local temperature of the medium gases entering the turbine at takeoff power settings may be as high as thirty five hundred degrees Fahrenheit. In the embodiment shown the temperatures of the turbine components are controlled by flowing cooling air to the chamber 26 from the compressor section of the engine through suitable conduit means which are not specifically shown. The conduit means may be either external to the turbine case 18 or may be contained entirely therein. The cooling air is at a pressure which is sufficiently high to permit discharge into the path 12, without auxiliary pumping and is at a temperature sufficiently low to provide the required cooling capacity.

The shroud 24 radially separates the flow path 12 from the chamber 26. In the embodiment shown the shroud is penetrated by the vanes 16 which extend into the flow path to control the medium gases flowing therethrough. The shroud is radially positioned by the turbine case 18 and, accordingly, the diameter of the shroud is a function of the turbine case diameter as established by the turbine case temperature. The temperature of the turbine case and the temperature of the shroud 24 are not always in phase and severe thermal distortion would occur in most engines if the shroud were not segmented.

Under varied engine operating conditions the case responds to changing flow path temperatures at a much slower rate than does the shroud. Accordingly, the gap 34 between each pair of the adjacent shroud segments 32 accommodates free differential expansion without inducing thermal stress. As is shown in FIG. 3, the gap extends through the cylindrical aperture 36 in which the vane platform 22 is mounted. In the as-assembled condition or under engine conditions wherein the case 18 is fully expanded and the shroud segments 32 are only partially expanded, it is apparent that the cylindrical aperture 36 becomes ovalized without a corresponding distortion of the vane platform.

Sealing means including the split ring 38 prevents the excessive leakage of cooling air between the platform 22 and the corresponding aperture 36 under even severely distorted conditions. The splits in the ring 38 are aligned with the gap 34 between adjacent shroud segments 32 in order to minimize the effect of shroud distortions on the sealing means. The indexing tabs 44 on the guide tube 42 maintain this alignment as is shown in FIG. 4. In one embodiment the ring 38 is further split into four (4) sections to permit closer conformity of the ring with the cylindrical aperture than is obtainable with two sections.

The spring member 40 urges the split ring 38 against the corresponding aperture 36 and platform 22. In the embodiment shown the spring member is manufactured from a section of convoluted tubing which is slotted axially at one or more locations to obtain a preferred stiffness.

The gaps 34 between adjacent shroud segments 32 are advantageously aligned with the guide vanes 16 to minimize the length of discontinuities along the flow path which cause deteriorated performance. The alignment additionally reduces the adverse effect of the discontinuity by confining the discontinuity to a present region of disrupted flow.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. In a gas turbine engine having an annular flow path for the working medium gases which extends through the turbine section of the engine and having a cooling air chamber located radially outward of the flow path, apparatus for preventing excessive leakage of cooling air from the chamber into the flow path, which comprises:

a plurality of segments supported between the annular flow path and the chamber in side to side relationship wherein said segments are contoured to form a cylindrical aperture between each pair of adjacent segments;

a plurality of turbine vanes, each having a cylindrical platform which is rotatably mounted within one of the cylindrical apertures between adjacent segments;

a split ring abutting each cylindrical aperture and the corresponding platform of the vane mounted therein; and a spring member comprising a section of convoluted tubing operatively disposed to urge said ring against the aperture and the corresponding platform to prevent the leakage of cooling air therebetween as differential component growths during operation of the engine cause ovalization of said aperture.

2. In a gas turbine engine having an annular flow path for the working medium gases which extends through the turbine section of the engine and having a cooling air chamber located radially outward of the flow path, apparatus for preventing excessive leakage of cooling air from the chamber into the flow path, which comprises:

a plurality of segments supported between the annular flow path and the chamber in side to side relationship wherein said segments are contoured to form a cylindrical aperture between each pair of adjacent segments;

a plurality of turbine vanes, each having a cylindrical platform which is rotatably mounted within one of the cylindrical apertures between adjacent segments;

a split ring abutting each cylindrical aperture and the corresponding platform of the vane mounted therein;

a spring member operatively disposed to urge said ring against the aperture and the corresponding platform to prevent the leakage of cooling air therebetween as differential component growths during operation of the engine cause ovalization of said aperture;

guide means for centering said spring member about the axis of each rotatable guide vane; and indexing means for aligning the split in said ring with the abutting edges of the adjacent segments.

* * * * *